United States Patent [19]

Gonzales, Jr.

[11] Patent Number: 4,620,460

[45] Date of Patent: Nov. 4, 1986

[54] SOCKET SET

[76] Inventor: Frank Gonzales, Jr., 33657 Arrowhead, Westland, Mich. 48185

[21] Appl. No.: 750,452

[22] Filed: Jul. 1, 1985

[51] Int. Cl.[4] ..... B25B 13/06

[52] U.S. Cl. ..... 81/124.4; 81/177.2; 81/185; 81/DIG. 11; 81/177.85

[58] Field of Search ..... 81/121.1, 124.3–124.7, 81/177.85, 177.1, 177.2, 177.4, 437–439, 185, DIG. 11

[56] References Cited

U.S. PATENT DOCUMENTS 2,758,494 8/1956 Jenkins ..... 81/438

2,991,678 7/1961 Adolphson ..... 81/124.4 X

FOREIGN PATENT DOCUMENTS 476954 5/1929 Fed. Rep. of Germany ..... 81/124.5

*Primary Examiner*—Frederick R. Schmidt
*Assistant Examiner*—Debra S. Meislin
*Attorney, Agent, or Firm*—Edwin E. Greigg

[57] ABSTRACT

A socket set in which all of the sockets of decreasing order can interfit into each other and for connecting to the drive for transporting from one place to another. Each of the sockets may be interchanged in position so that the sockets may be engaged with each other and used as an extension for any other socket size.

1 Claim, 4 Drawing Figures

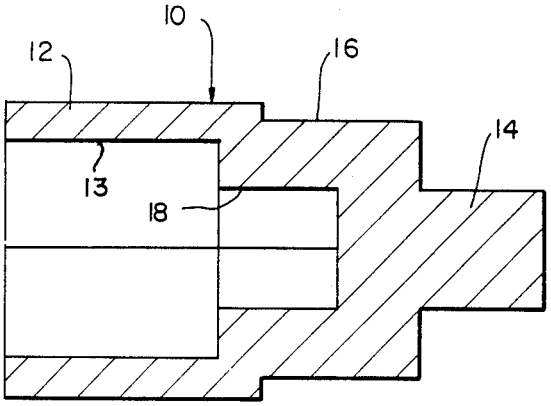
FIG 1
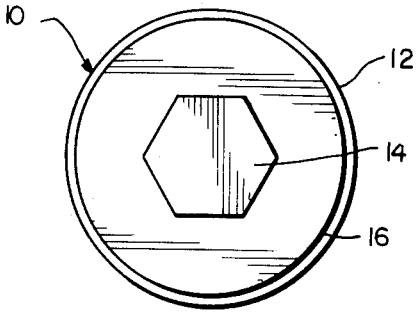
FIG 2
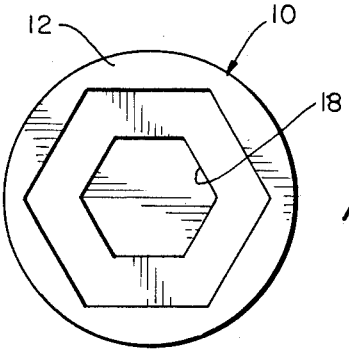
FIG 3
FIG 4
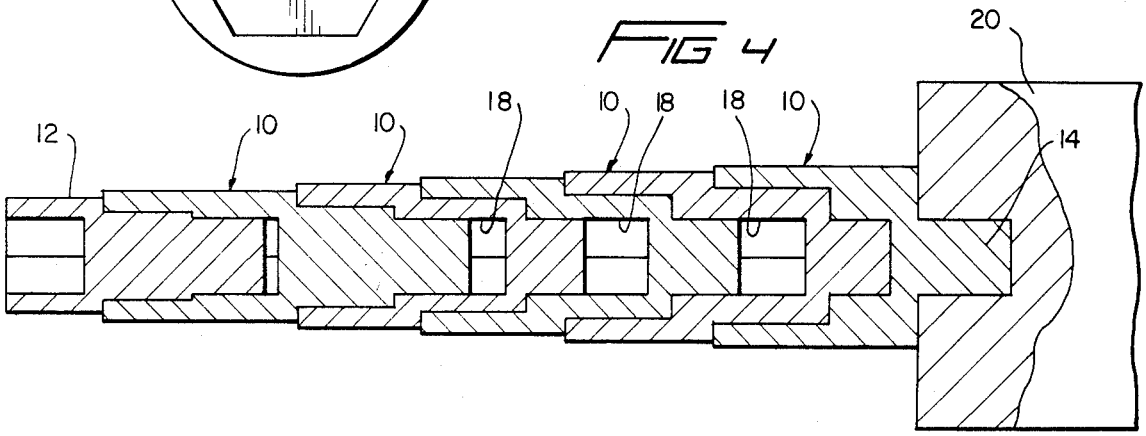

SOCKET SET

BACKGROUND OF THE INVENTION

This invention is directed to wrenches and more particularly to a socket set type wrench in which each sized socket can be carried by other sized sockets where the sockets may be used as an extension.

Heretofor various types of socket wrenches have been used in which the sockets have been stored end-to-end on a drive bar, such as shown in U.S. Pat. No. 1,371,350. Another type has been set forth in U.S. Pat. No. 851,068 in which different sized sockets fit one over the other gradually increasing in size to accomodate larger sized sockets where the larger sized socket must be removed in order to use the lesser sized socket. Other types are well known to those skilled in the art.

This invention provides a socket set in which each socket member interfits with other socket members by which all sockets members can be carried in an assembly and interchanged in order to use a desired sized socket member.

It is therefore an object to provide a socket set in which each of the socket members interfit with other socket members.

Another object is to provide a socket set in which the different sized sockets can be used as an extension or individually for close-up work.

Still another object is to provide a socket set by which the socket members can be interchanged so that the desired socket is on the end by which it can be used.

BRIEF DESCRIPTION OF THE DRAWINGS

FIG. 1 is a cross sectional view of a socket;

FIG. 2 is an end view looking toward the shank end of the socket of FIG. 1;

FIG. 3 is an end view of the socket looking at the socket end of the socket member of FIG. 1;

FIG. 4 illustrates different sized socket members assembled together and to the drive handle;

DETAILED DESCRIPTION

FIG. 1 is a cross-sectional view of a single socket member 10 which includes a socket end 12 having a hexagonal shaped inner surface 13 as shown in FIG. 3 which is made in any desired size to fit a corresponding sized nut or bolt head. The socket member includes a shank end 14 which is of hexagonal shape by which the socket is driven by an appropriate drive means 20. The middle section 16 of the socket member includes a hexagonal outer surface with an axially aligned internal inset 18 extending from the socket end toward said shank end and having the same shape and size as the shank end so that the shank end of another socket member can be received therein. The middle section of the socket member is formed with a hexagonal outer surface having the same outer dimension as that of the next largest adjacent socket member so that the middle section will interfit within the next largest adjacent socket member and the shank end will also fit into the inset 18 of the adjacent socket member. Each socket member of different size has a middle section with the outer dimension of the next largest adjacent sized socket member with a shank end which has the same dimension as any other shank end.

FIG. 4 shows the different sized socket members assembled together on a drive handle 20 with the middle section 16 of each socket member 10 interfitting into the next larger adjacent sized socket member and the shank end of each socket member fitting into the inset 18 of the adjacent socket member. For simplification the socket members have been indicated with metric sizes as shown on the socket end of the socket member. The largest socket member here shown as 11 mm can be made with a cylindrical outer surface along the middle section because only the shank end of the largest socket member will fit into the inset of the drive member or into the 6 mm socket member which is the same size as the inset in the drive member.

The socket set as shown in FIG. 4 can be used for close up work by removing the combined socket members from the drive means and then selecting the desired socket and inserting the shank end of the selected socket member into the drive means. The selected socket member will then fit that sized bolt head or nut. If it is desired to use the socket members as an extension, the number of sockets for the length desired may be selected and the socket of the correct size is placed at the end of the extension removed from the drive means as formed by the socket members. For illustration, lets assume that the 9 mm socket is to be used and the entire assembly of socket members are needed for the extension. The 11 mm socket member will be removed from the drive means, the 6 mm, 7 mm, and 8 mm socket members will be removed together from the 9 mm socket member with the 9 mm socket member connected to the 10 mm socket member which is connected to the 11 mm socket member. The shank of the 8 mm socket member is inserted into the drive means 20 and the shank of the 11 mm socket member is inserted into the 6 mm socket. Therefore, the 9 mm socket member will be on the end of all other socket members.

In a situation where the 9 mm socket is required with an extension shorter than the total number of sockets, then the extension can be made by removing the 6 mm, 7 mm and 8 mm socket members and inserting the desired number of socket members between the drive means and the 9 mm socket member or removing socket members from between the drive means and the 9 mm socket member as the situation may require.

As set forth above, the 6 mm socket member is required in forming an extension with any other sized socket member because the shank ends are too short. It would be obvious to one skilled in the art that the shank ends can be made long enough to extend into the inset of any socket member, then any sized socket member can be matched with any other socket member and in any order. Therefore, if any one of the socket members are lost an extension with the remaining socket members can be formed. In the above set forth socket set, the 6 mm socket member would be required in certain situations. With shanks long engough to extend through the socket section into the inset any socket member can be used with any other socket member.

It is obvious that the shank end 14 of each socket member, the inset 18 in the socket members 10 and the inset in the drive means and in the reversible adapter can be made of any desired size either metric or inch. Also, the inset shape can be square, hexagonal or any other desired shape so long as the shape is compatible with the shape of the shank on the socket members and of the inset in each of the socket members.

The foregoing relates to preferred exemplary embodiments of the invention, it being understood that other variants and embodiments thereof are possible within the spirit and scope of the invention, the latter being defined by the appended claims.

What is claimed and desired to be secured by Letters Patent of the United States is:

1. A socket set which comprises a plurality of socket members, each of said plurality of socket members including a different sized socket end with each of said plurality of sockets members having a shank end of the same size and shape, said plurality of socket members including a smallest sized socket member, a largest sized socket member, and intermediate sized socket members, said smallest sized socket member having a socket end with the same size and shape as said shank end, with a middle section between said socket end and said shank end, each of said intermediate sized socket members and said largest sized socket member having a middle section including an axially aligned inset extending from said socket end toward said shank end with said inset having the same size and shape as said shank end, each of said intermediate sized socket members and said smallest sized socket member having their middle section with an outside surface dimension and shape the same dimension and shape as the socket end of the next larger sized socket end, whereby the shank end of any of said plurality of socket members will fit into a drive means as well as into the socket end of said smallest sized socket member, and the shank end of any of said plurality of socket members will fit through the socket end of any larger sized socket member and into the inset of said larger sized socket member so that an assembly of said plurality of socket members may be formed with a desired sized socket end on an end of said assembly.

* * * * *